US006494551B1

(12) United States Patent
Markley

(10) Patent No.: US 6,494,551 B1
(45) Date of Patent: Dec. 17, 2002

(54) PINCHED RAIL DRAWER GUIDE SYSTEM

(76) Inventor: Joseph M. Markley, 5333 E. 7th St., Tucson, AZ (US) 85711

( * ) Notice: Subject to any disclaimer, the term of this patent is extended or adjusted under 35 U.S.C. 154(b) by 39 days.

(21) Appl. No.: 09/655,672

(22) Filed: Sep. 6, 2000

(51) Int. Cl.[7] ..... A47B 88/14
(52) U.S. Cl. ..... 312/334.7; 312/348.1
(58) Field of Search ..... 312/334.12, 334.15, 312/334.16, 334.18, 334.19, 334.39, 334.44, 334, 46, 334.4, 334.5, 334.6, 348.1

(56) References Cited

U.S. PATENT DOCUMENTS

| | | | | | |
|---|---|---|---|---|---|
| 2,319,555 | A | * | 5/1943 | Premo | 312/334.12 X |
| 2,997,355 | A | * | 8/1961 | Preble | 312/334.18 |
| 4,927,216 | A | * | 5/1990 | Boda | 312/334.12 X |
| 5,409,309 | A | * | 4/1995 | Giddings et al. | 312/334.5 X |
| 5,474,378 | A | * | 12/1995 | Smith et al. | 312/334.4 |
| 5,634,703 | A | * | 6/1997 | Vonier | 312/334.46 X |
| 5,909,862 | A | * | 6/1999 | Ratliff et al. | 248/117.4 |
| 5,984,442 | A | * | 11/1999 | Hellman, Jr. | 312/334.12 X |

* cited by examiner

*Primary Examiner*—John G. Weiss
*Assistant Examiner*—Michael J. Fisher
(74) *Attorney, Agent, or Firm*—Michael I Kroll

(57) ABSTRACT

Disclosed is a pinched rail guide system which is comprised of a pair of guide rails 18 exteriorly jointed to the parallel side walls 20 of a drawer 16 or the like. There are two sets of three guide rollers 14 positioned so that two of the guide rollers 24 are beneath the guide rail 18 and supporting the drawer-like member 16. The third guide roller 26 is stationed to engage the top of the guide rail 18 and which location is of paramount importance to the present invention 10. Sets of guide rollers 14 can be mounted to the structural drawer-like holding member 16 by individually fixedly mounting each guide roller 14 to the structural drawer-like holding frame member 12 according to the aforementioned prescribed method or each set 14 can be fixedly mounted to a guide roller plate member 40 Drawer stops 30 are located on the top rear section of the rails 38 and are milled into wooden rails 18 and are formed into metal rails 18. In operation the drawer-like member(s) 16 can be pulled open until the stops 30 in the upper tracks of the pinched rails 18 come in contact with the third guide rollers 26. Embodiments are also disclosed wherein dual guide rollers 62 are used, and, wherein pre-formed guide roller rails 18 are placed at the top 63 and bottom 64 of the drawers 16.

21 Claims, 17 Drawing Sheets

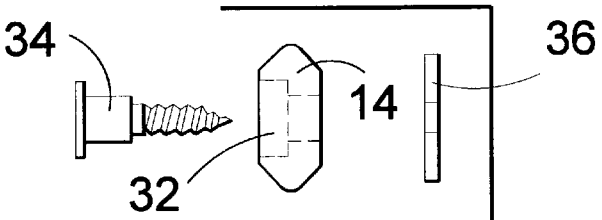
FIG 5
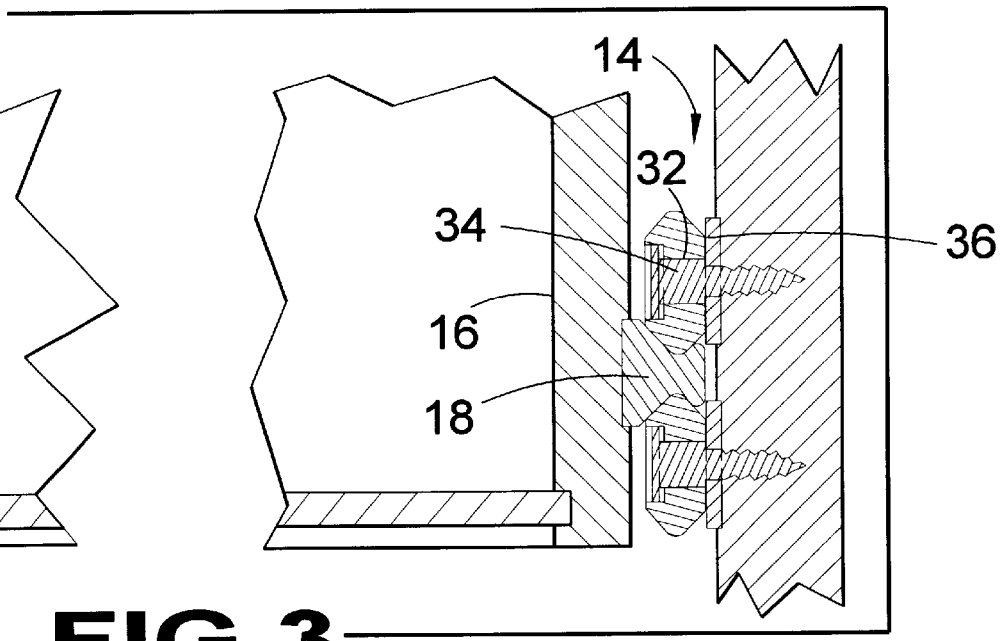
FIG 3
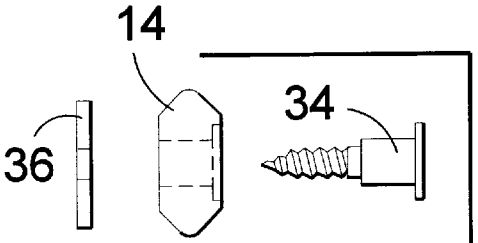
FIG 4
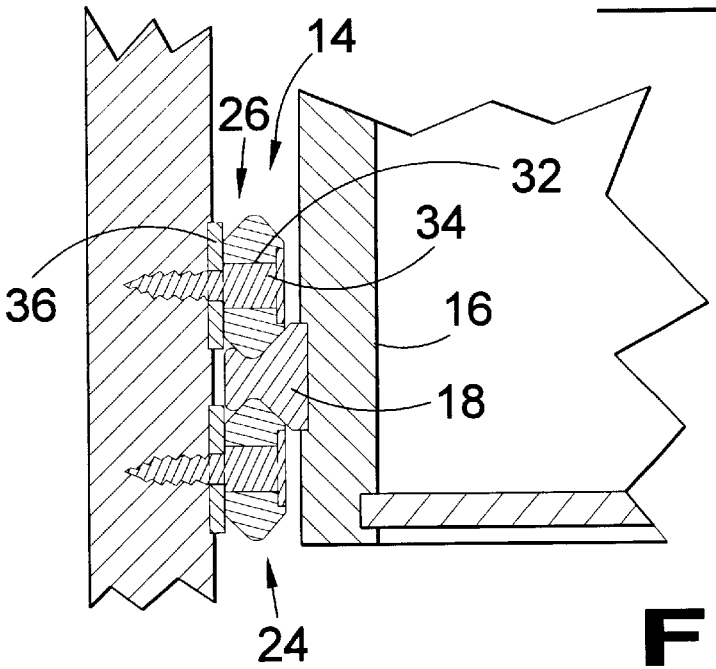

PINCHED RAIL DRAWER GUIDE SYSTEM

BACKGROUND OF THE INVENTION

1. Field of the Invention

The present invention relates generally to roller drawer guides and more specifically, to a pinched rail guide system that provides lateral relief to compensate for manufacturing tolerances and expansion and contraction during the life of the furniture. The pinched rail guide system is comprised of a pair of guide rails exteriorly mounted to the parallel side walls of a drawer or the like. There are two sets of three guide rollers positioned so that two of the guide rollers are beneath the guide rail and supporting the drawer-like member. The third guide roller is stationed to engage the top of the guide rail and whose location is of paramount importance to the present invention. Due to the fact that most manufacturing is performed on assembly lines by machinery that can consistently achieve tolerances within thousandths of millimeters, the third roller can be positioned so that a force is created on the guide rail between the third roller and the other guide rollers. Further, the third roller is fixedly attached at a point past the median point of the base guide rollers. This will prevent any vertical play while sliding the drawer-like member within the guide roller members.

This assemblage of guide rollers and rail is an improvement over the existing guide rail systems by requiring less hardware and case components while improving vertical and lateral stability over prior art. Installation of guide rollers is simplified when using the present invention as is drawer installation and removal.

In addition, the present invention allows for expansion and contraction of the drawer or like member(s) and the exterior structural drawer or like holding article. A first set of guide rollers and a second set of guide rollers form a mating set of guide rollers that are fixedly attached opposite the other and spaced apart by the drawer or like member. The sets can be mounted to the structural drawer-like holding member by individually fixedly mounting each guide roller to the structural drawer-like holding frame member according to the aforementioned prescribed method or each set can be fixedly mounted to a guide roller plate member. The first set of guide rollers has each roller rotatably mounted onto a guide roller hub element. The second set of guide rollers has each roller rotatably mounted onto a guide roller hub element. Each guide roller of the second set being mounted onto the guide roller hub element has a through bore which varies in size whereby the head of the guide roller mounting element is contained in a cavity within the guide roller which permits the guide roller to move in a transaxle fashion dictated by the variable expansion and contraction of the drawer-like member and the exterior structural drawer-like holding article.

Drawer stops are located on the top rear section of the rails and are milled into wooden rails and are formed into metal rails. In operation the drawer-like member(s) can be pulled open until the stops in the upper tracks of the pinched rails come in contact with the third guide rollers. To remove the drawer-like member the drawer-like member is extended to its full open position whereupon the guide rail stops will be engaged by the third guide roller members. The face member is raised pivoting on the first guide roller members until the guide rail stops pass under the third guide roller members whereby the drawer-like member can be completely withdrawn from the exterior structural drawer-like holding article. The degree of difficulty for removal of the drawer member is decreased compared to those of conventional guide systems. The clearance needed above the drawer member is also reduced due to change in removal procedure allowing the manufacturer to use larger drawers in a given face frame opening.

2. Description of the Prior Art

There are numerous roller drawer guide systems which provide for guiding and limiting the movement of sliding drawers. While these roller drawer guide systems may be suitable for the purposes for which they were designed, they would not be as suitable for the purposes of the present invention as heretofore described. The present invention offers many improvements to both manufacturers and users. It is thus desirable to provide a roller drawer guide system utilizing pinched rails to achieve vertical and lateral stabilization of the drawer member while maintaining a smooth, quiet ride, ease of removal and installation, and lower manufacturing costs. It is further desirable to provide a pinched rail drawer guide system that allows compensation for lateral differentiation while maintaining lateral stability through a combination of fixed and lateral relief wheel guides.

It is yet further desirable to provide a pinched rail drawer guide system that may be configured to accommodate milled or formed rails each of which can be either assembly mounted or a screw mounted to the furniture piece.

SUMMARY OF THE PRESENT INVENTION

The present invention discloses a pinched rail guide system which is comprised of a pair of guide rails exteriorly jointed to the parallel side walls of a drawer or the like. There are two sets of three guide rollers positioned so that two of the guide rollers are beneath the guide rail and supporting the drawer-like member. The third guide roller is stationed to engage the top of the guide rail and which location is of paramount importance to the present invention. Sets of guide rollers can be mounted to the structural drawer-like holding member by individually fixedly mounting each guide roller to the structural drawer-like holding frame member according to the aforementioned prescribed method or each set can be fixedly mounted to a guide roller plate member. Drawer stops are located on the top rear section of the rails and are milled into wooden rails and are formed into metal rails. In operation the drawer-like member (s) can be pulled open until the stops in the upper tracks of the pinched rails come in contact with the third guide rollers. Embodiments are also shown wherein dual guide rollers are used, and, pre-formed guide rails are placed at the top and bottom of the sides of the drawer-like member.

An object of the present invention is to provide a lateral relief pinched rail drawer guide system that is self compensating to variations in drawer width through the use of a combination of slidable lateral relief wheel guides and fixed wheel guides.

A primary object of the present invention is to provide a pinched rail drawer guide system with lateral relief which will overcome the shortcomings of prior art devices.

Another object of the present invention is to provide a pinched rail drawer guide system wherein rails have grooved tracks to accommodate the wheel guides and restrict vertical movement more effectively than the prior art thereby increasing lateral and vertical stability and allowing a smoother, quieter travel.

Another object of the present invention is to provide a pinched rail drawer guide system wherein all of the wheel guides on either side of the drawer member are proximally located within the housing member and are positioned to require less clearance above drawer and greater ease to remove or install the drawer member than is needed in the prior art thereby increasing the spatial efficiency of each drawer member.

A still further object of the present invention is to provide a pinched rail drawer guide system with a retrofit version that can be adapted to existing sliding drawer systems.

Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

FIG. 3 is a cross sectional view taken from FIG. 1 as indicated. Shown is a drawer-like member being supported by the guide rollers. Also shown are disc shaped members having a centrally located aperture wherethrough is mounted the fastener element of the guide roller. Therein providing a structural element to the individually mounted guide rollers. The guide rail is pinched between the upper and lower guide roller members. The guide roller members on one side have a centrally disposed cavity wherethrough the guide roller fastener mounts flush to the washer-like structural reinforcement member. The guide roller will be able to travel in alignment with the guide rail as the drawer-like member expands and contracts over the life of the furniture.

FIG. 4 is an exploded view of one type of guide roller member having a guide roller member rotatably mounted on a guide roller fastener element. Also shown is a disc shaped reinforcement element which can be partial imbedded providing structural integrity and exact location for the guide roller member.

FIG. 5 is an exploded view of another guide roller member having a guide roller member rotatably mounted on a guide roller fastener element. Also shown is a disc shaped reinforcement element which can be partial imbedded providing structural integrity and exact location for the guide roller member. The cavity within the guide roller provides means for the guide roller to slide as needed for lateral relief on the guide roller fastener element.

LIST OF REFERENCE NUMERALS

Figure 1:
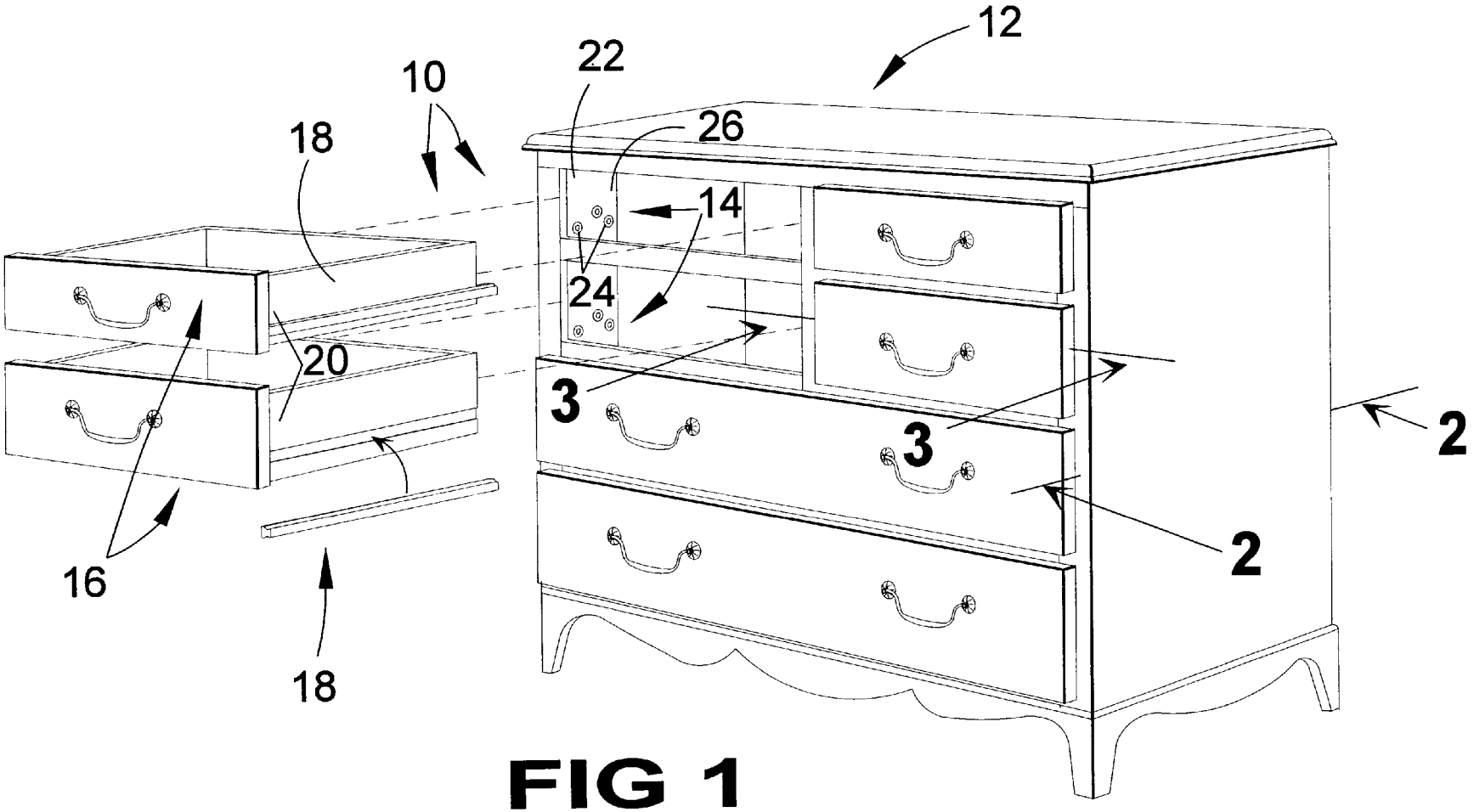
FIG. 1 is a perspective view of the present invention installed within a piece of furniture. Shown are the guide rollers which position a sliding drawer by supporting and compressing a guide rail. The sliding drawer member has pinched rails extending perpendicularly longitudinally along the outer sides of the drawer. The guide rollers are fixedly positioned to pinch the guide rail which is fixedly attached to a drawer or like member. The fixed guide rollers are installed in a triangular configuration within the housing member on one sidewall with two lower guide wheels on a level plane and one upper guide wheel between and above the lower guide wheels set at a predetermined distance to sufficiently receive one of the guide rails on the drawer or like member. The installation configuration of the oppositely opposed guide rollers is of similar construction.

With regard to reference numerals used, the following numbering is used throughout the drawings.

10 present invention
12 furniture
14 guide rollers
16 drawer
18 guide rail
20 sides of drawer
22 furniture sidewall
24 lower guide rollers
26 upper guide rollers
28 end of drawer
30 drawer stop
32 aperture
34 fasteners
36 washer
38 extended rail guide
40 mounting plate
42 face frame
44 fastener
46 roller assembly
48 template
50 holes
52 alignment flange
54 bottom flange
56 compression plug
58 transition
60 underside of rail
62 dual guide rollers
63 top element
64 bottom element
66 rolled guide rail

DESCRIPTION OF THE PREFERRED EMBODIMENT(S)

In order that the invention may be more fully understood, it will now be described, by way of example, with reference to the accompanying drawings in which FIGS. 1 through 21 illustrate the present invention being a pinched rail drawer guide system Turning to FIG. 1, shown therein is a perspective view of the present invention 10 installed within a piece of furniture 12. Shown are the guide rollers 14 which position a sliding drawer 16 by supporting and compressing a guide rail 18. The sliding drawer member 16 has pinched rails 18 extending longitudinally along the perpendicular outer sides 20 of the drawer. The guide rollers 14 are fixedly positioned to pinch the guide rail 18 which is fixedly attached to a drawer 16 or like member. The fixed guide rollers 14 are installed in a triangular configuration within the housing or furniture member 12 on one interior sidewall 22 with two lower guide wheels 24 spaced apart on a level horizontal plane and one upper guide wheel 26 between and above the lower guide wheels 24 set at a predetermined distance to sufficiently receive thereinbetween one of the guide rails 18 on the drawer 16 or like member. The installation configuration of the oppositely opposed guide rollers 14 is of similar construction.

Figure 2:
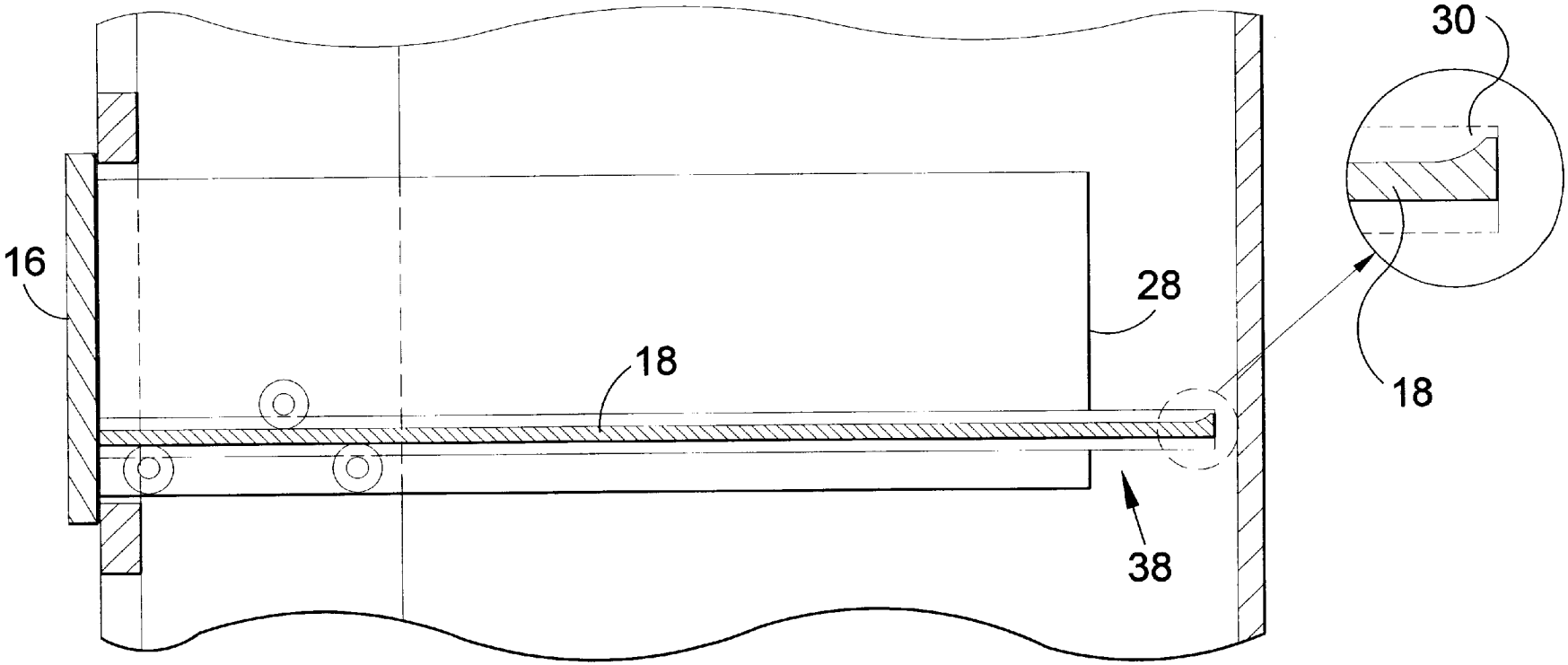
FIG. 2 is a cross sectional view taken from FIG. 1 as indicated. Shown is typical mounting of a drawer-like member having a guide rail extending beyond the distal end of the drawer-like member whereby the drawer-like member can be fully extended. Also shown is a partial cutaway view of the guide rail and guide rollers. Shown in detail is a drawer stop milled into the upper rear section of the wooden guide rail.

Turning to FIG. 2, shown therein is a cross sectional view taken from FIG. 1 as indicated. Shown is a typical mounting of a drawer-like member 16 having a guide rail 18, 38 extending beyond the distal end 28 of the drawer-like member 16 whereby the drawer-like member can be fill extended. Also shown is a partial cutaway view of the guide rail 18. Shown in detail is a drawer stop 30 milled into the upper rear section of the wooden guide 18.

Turning to FIG. 3, shown therein is a cross sectional view taken from FIG. 1 as indicated. Shown is a drawer-like member 16 being supported by the guide rollers 14. Also shown are disc shaped individual roller members 14 having a centrally located aperture 32 wherethrough is mounted the fastener element 34 of the guide roller 14 therein providing a structural stabilizing element to the individually mounted guide rollers 14. The guide rail 18 is pinched between the upper and lower guide roller members 24, 26. The guide roller members 14 on one side have a centrally disposed cavity 32 wherethrough the guide roller fastener 34 mounts flush to the washer-like structural reinforcement member 36. The guide roller 14 will be able to travel in alignment with the guide rail 18 as the drawer-like member 16 expands and contracts over the life of the furniture.

Turning to FIG. 4, shown therein is an exploded view of one type of guide roller member 14 having a guide roller member rotatably mounted on a guide roller fastener 34 element having a threaded means thereon. Also shown is a disc shaped reinforcement element 36 which can be partially imbedded in the furniture sidewall providing structural integrity and exact location for the guide roller member 14.

Turning to FIG. 5, shown therein is an exploded view of another guide roller member 14 having a guide roller member rotatably mounted on a guide roller fastener element 34. Also shown is a disc shaped reinforcement element 36 which can be partial imbedded providing structural integrity and exact location for the guide roller member. The cavity 32 within the guide roller 14 provides means for the guide roller 14 to slide on fastener 34 as needed for lateral relief on the guide roller fastener element 34.

Figure 6:
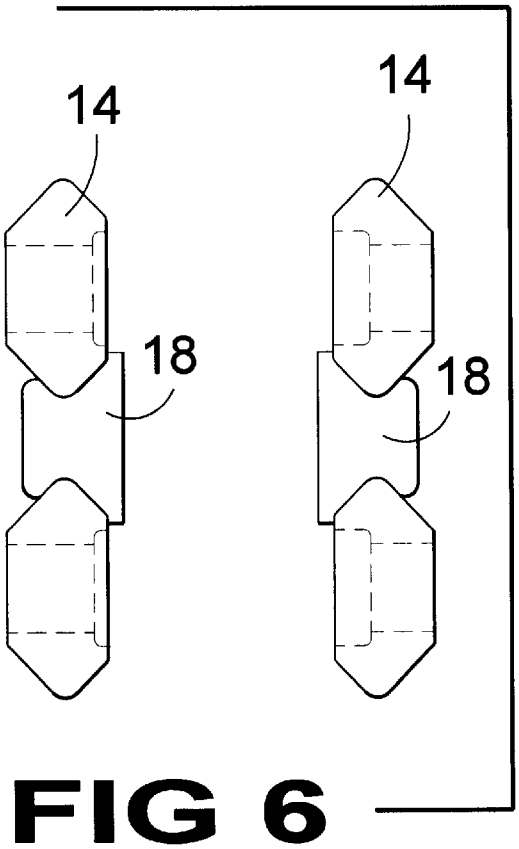
FIG. 6 is a front view of a set of guide rollers with one type of guide rail. The compression of the guide rail eliminates movement of the drawer-like member during its operation cycle. Further the oppositely opposed guide roller member provides horizontal movement of the guide roller during expansion and contraction of the drawer-like member.

Turning to FIG. 6, shown therein is a front view of a set of guide rollers with one type of guide rail 18. The compression of the guide rail 18 between guide rollers 14 eliminates movement of the drawer-like member during its operation cycle. Further the oppositely opposed guide roller member 14 provides horizontal movement of the guide roller 14 during expansion and contraction of the drawer-like member.

Figure 7:
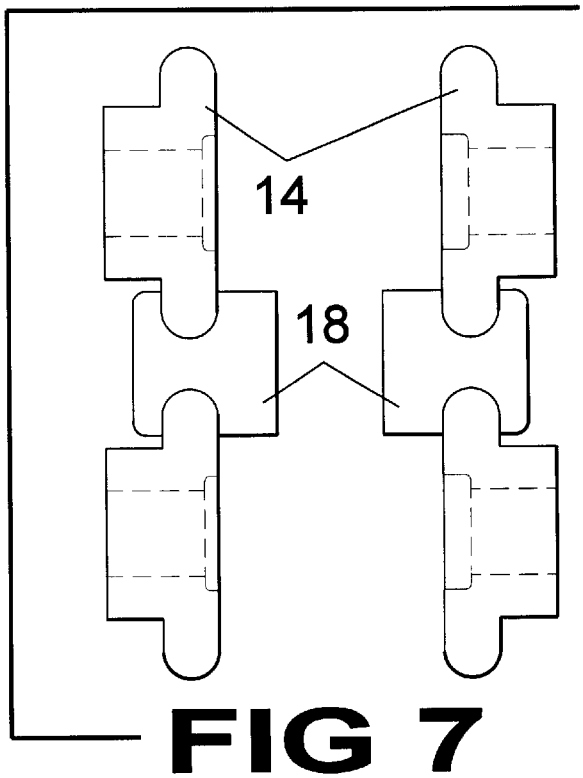
FIG. 7 is a front view of another set of guide rollers compressing one type of guide rail. The compression of the guide rail eliminates movement of the drawer-like member during its operation cycle. Further the oppositely opposed guide roller member provides horizontal movement of the guide roller during expansion and contraction of the drawer-like member.

Turning to FIG. 7, shown therein is a front view of another set of guide rollers 14 compressing one type of guide rail 18 thereinbetween. The compression of the guide rail 18 eliminates movement of the drawer-like member during its operation cycle. Further the oppositely opposed guide roller member 14 provides horizontal movement of the guide roller 14 during expansion and contraction of the drawer-like member.

Figure 8:
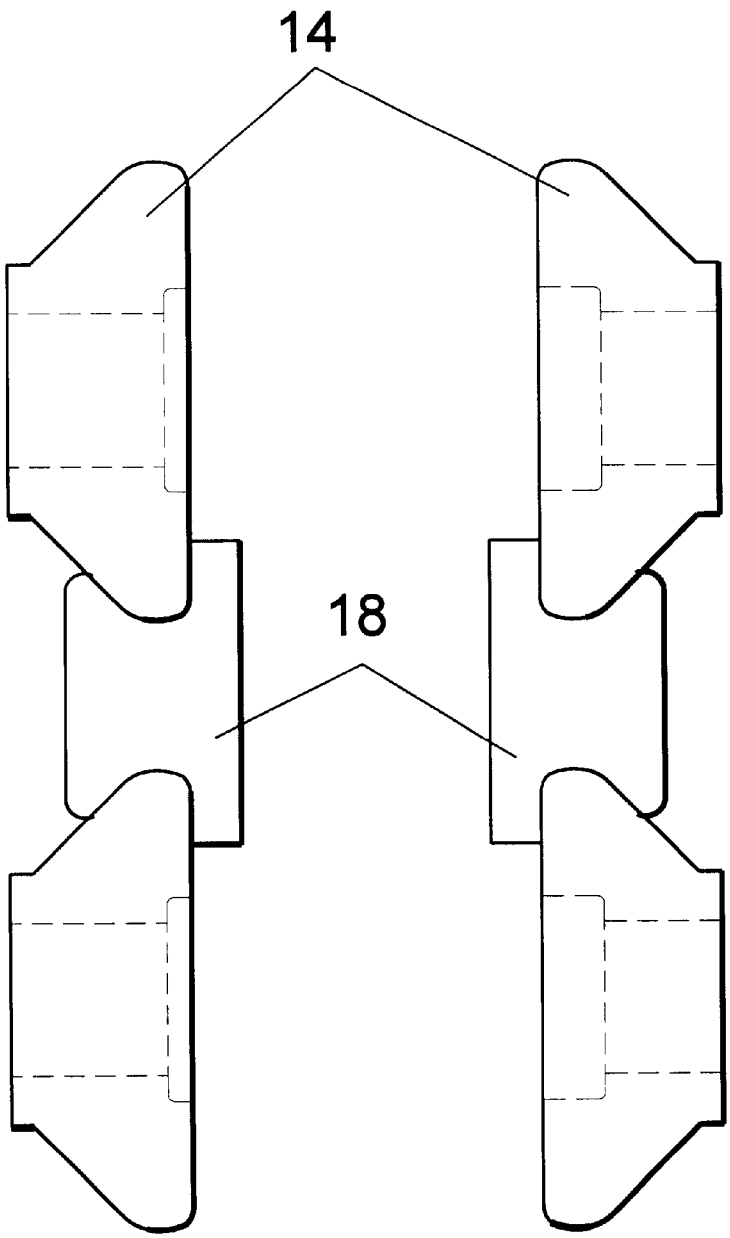
FIG. 8 is a front view of another set of guide roller members compressing one type of guide rail. The compression of the guide rail eliminates movement of the drawer-like member during its operation cycle. Further the oppositely opposed guide roller member provides horizontal movement of the guide roller during expansion and contraction of the drawer-like member.

Turning to FIG. 8, shown therein is a front view of another set of guide roller members 14 compressing one type of guide rail 18 thereinbetween. The compression of the guide rail 18 eliminates movement of the drawer-like member during its operation cycle. Further the oppositely opposed guide roller member 14 provides horizontal movement of the guide roller during expansion and contraction of the drawer-like member.

Figure 9:
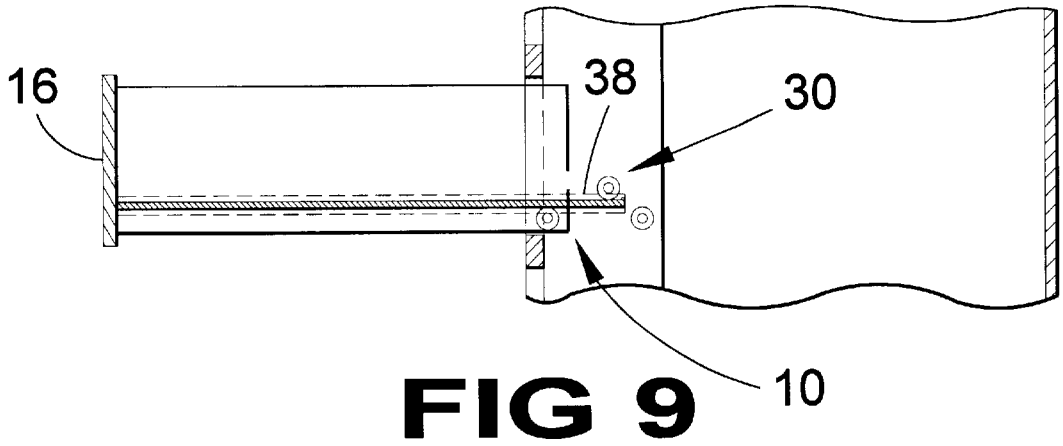
FIG. 9 is a side view of the drawer-like element having the guide mechanism of the present invention installed thereon. Shown is the drawer-like member in the fully extended position having a stop element preventing further extension of the drawer-like member. The extended rail guide provides for the full extension of the drawer-like member.

Turning to FIG. 9, shown therein is a side view of the drawer-like element 16 having the guide mechanism of the present invention 10 installed thereon. Shown is the drawer-like member 16 in the fully extended position having a stop element 30 preventing further extension of the drawer-like member. The extended rail guide 38 provides for the fill extension of the drawer-like member 16.

Figure 10:
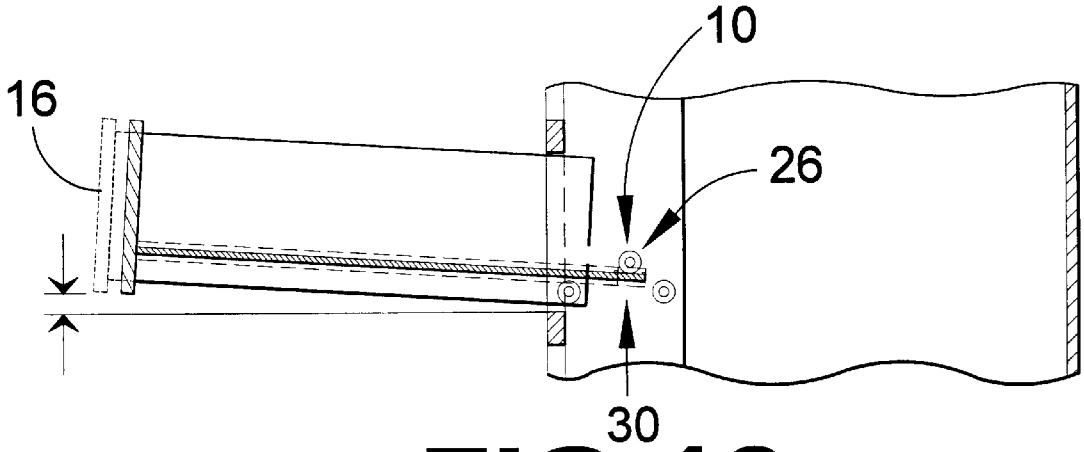
FIG. 10 is a side view of the drawer-like element having the guide mechanism of the present invention installed thereon. Shown is the drawer-like member in the fully extended position being removed from the guide rail by raising the drawer-like member until the stop element clears the upper guide roller. The space required to lift the drawer-like member is smaller than is presently allowable within the prior art. Thereby permitting larger drawer-like members to be used.

Turning to FIG. 10, shown therein is a side view of the drawer-like element 16 having the guide mechanism of the present invention 10 installed thereon. Shown is the drawer-like member 16 in the fully extended position being removed from the guide rail by raising the front of the drawer-like member until the stop element 30 clears the upper guide roller 26. The space required to lift the drawer-like member is smaller than is presently allowable within the prior art thereby permitting larger drawer-like members to be used.

Figure 11:
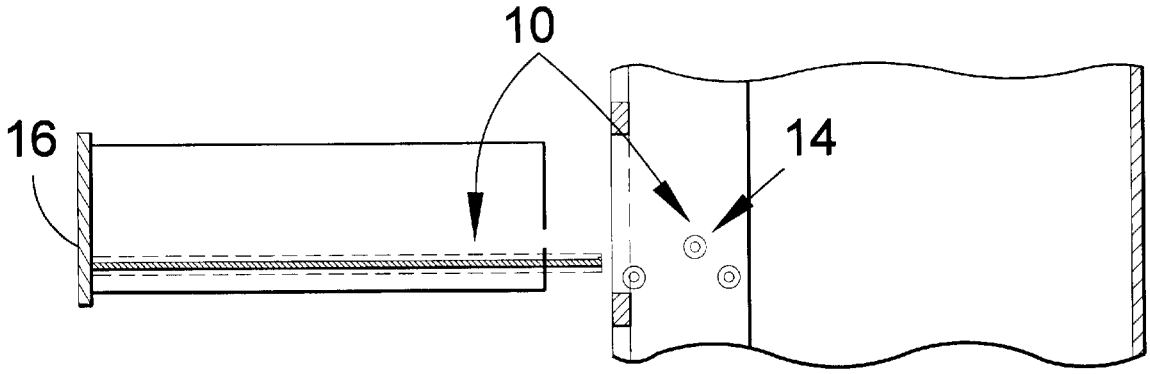
FIG. 11 is a side view of a drawer-like member having the present invention installed thereon. Shown is the drawer-like member fully dismounted from the guide rails.

Turning to FIG. 11, shown therein is a side view of a drawer-like member 16 having the present invention 10 installed thereon. Shown is the drawer-like member fully dismounted from the guide rollers 14.

Figure 12:
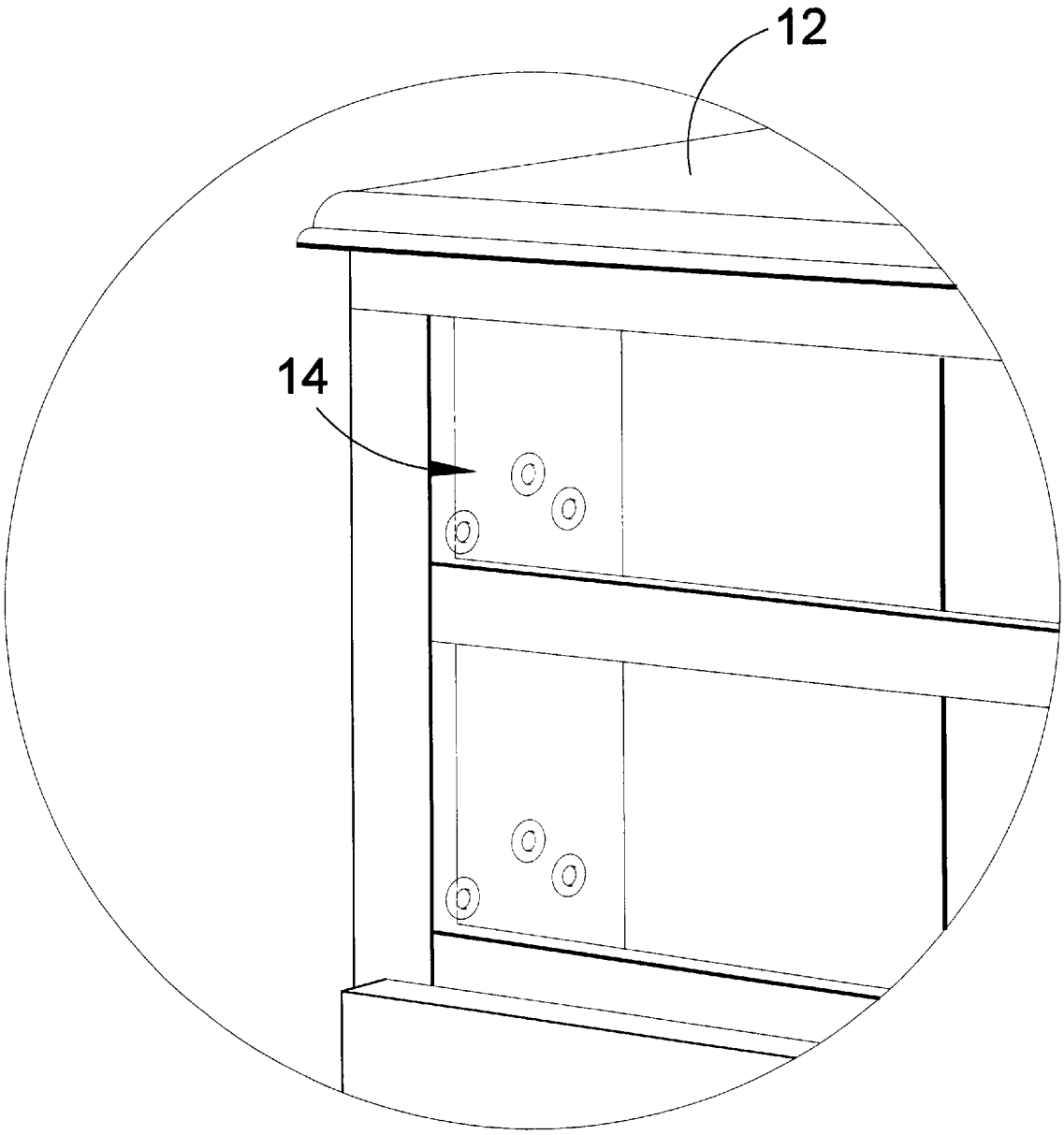
FIG. 12 is an enlarged view of the individually mounted guide roller members having a support member for mounting the roller guides thereon.

Turning to FIG. 12, shown therein is an enlarged view of the individually mounted guide roller members 14 and furniture 12 having a sidewall 22 support member for mounting the roller guides thereon.

Figure 13:
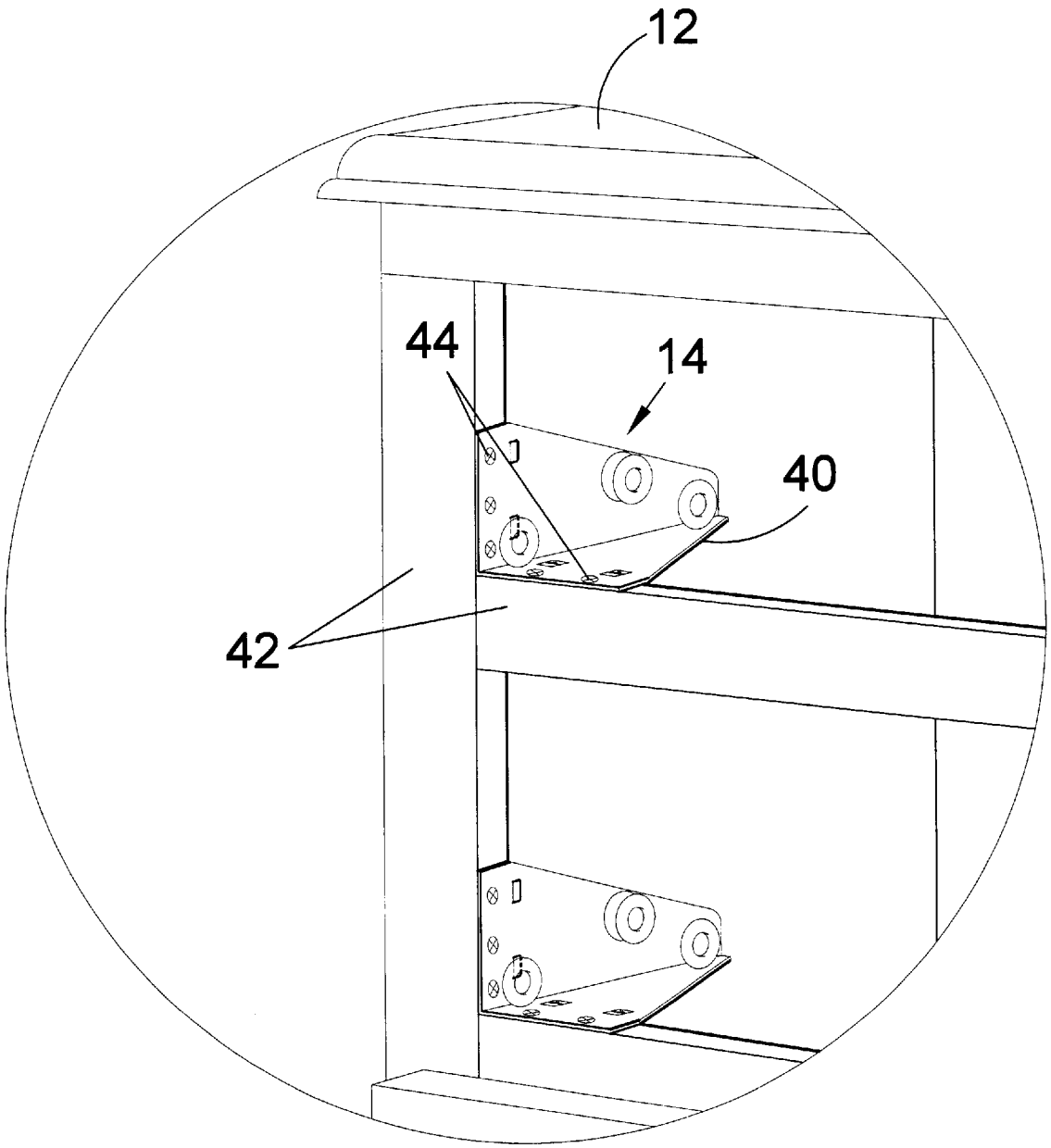
FIG. 13 is a perspective view of the guide roller members fixedly attached to a mounting plate whereby the guide rollers can be mounted to the face frame of the furniture. Thereby eliminating the need for additional support members.

Turning to FIG. 13, shown therein is a perspective view of the guide roller members 14 fixedly attached to a mounting plate 40 whereby the guide rollers can be mounted with fasteners 44 to the face frame 42 of the furniture 12 thereby eliminating the need for additional support members.

Figure 14:
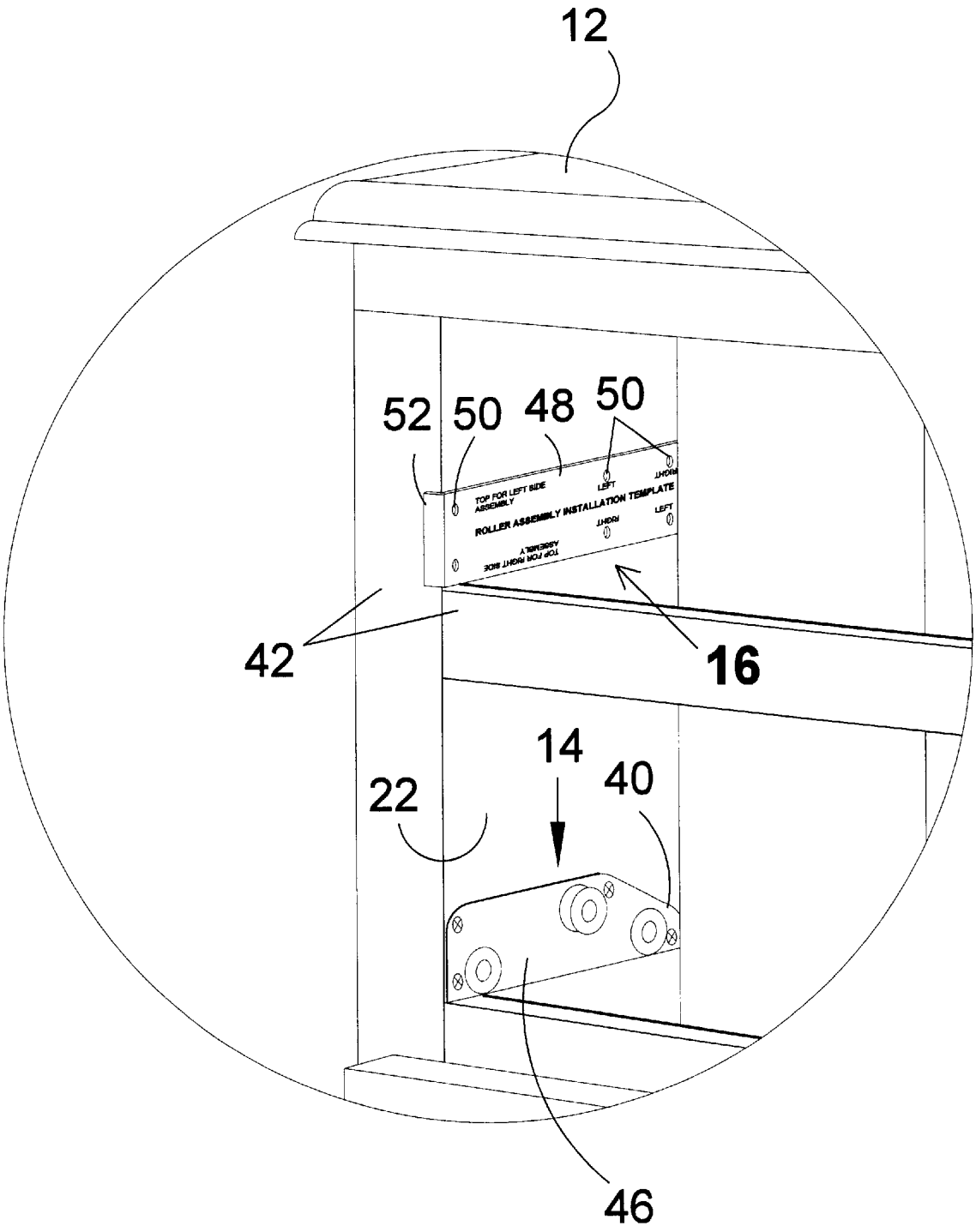
FIG. 14 is a perspective view of another type of furniture wherein the interior lower drawer area has left side guide roller members that are fixedly attached to a mounting plate forming a roller assembly whereby the roller assembly is mounted flush to the interior side wall of the furniture and the upper drawer area has a roller assembly installation template in place to accurately pre-drill the holes in proper alignment for installing another left side roller assembly. The bottom of the template is sitting on the face frame to insure the proper height and an alignment plate extends at a right angle to square the template. The template is universal and can be used for installing both left and right roller assemblies by simply inverting the template thereby allowing precise, quick, and consistent installation of the roller assembly.

Turning to FIG. 14, shown therein is a perspective view of another type of furniture 12 wherein the interior lower drawer area has left side guide roller members 14 that are fixedly attached to a mounting plate 40 forming a roller assembly 46 whereby the roller assembly is mounted flush to the interior side wall 22 of the furniture 12 and the upper drawer area has a roller assembly installation template 48 in place to accurately pre-drill the holes 50 in proper alignment for installing another left side roller assembly 46. The bottom of the template 48 is sitting on the face frame 42 to insure the proper height and an alignment plate 52 or flange extends at a right angle to square the template 48. The template 48 is universal and can be used for installing both left and right roller assemblies by simply inverting the template thereby allowing precise, quick, and consistent installation of the roller assembly 46.

Figure 15:
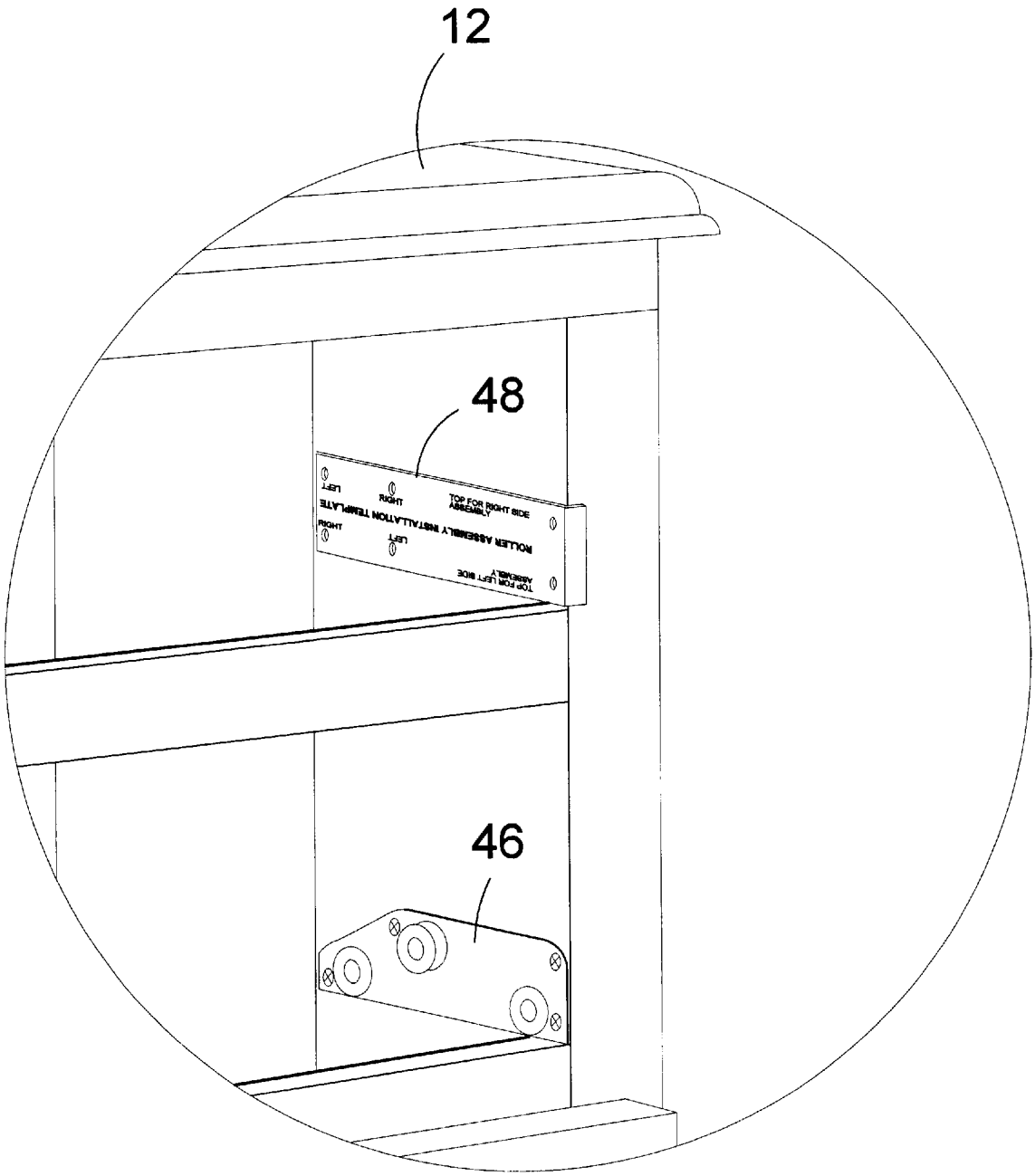
FIG. 15 is a perspective view showing template being used on right side.

Turning to FIG. 15 shown therein is a perspective view showing template 48 and roller assembly 46 being used on right side of furniture 12 similar to FIG. 14.

Figure 16:
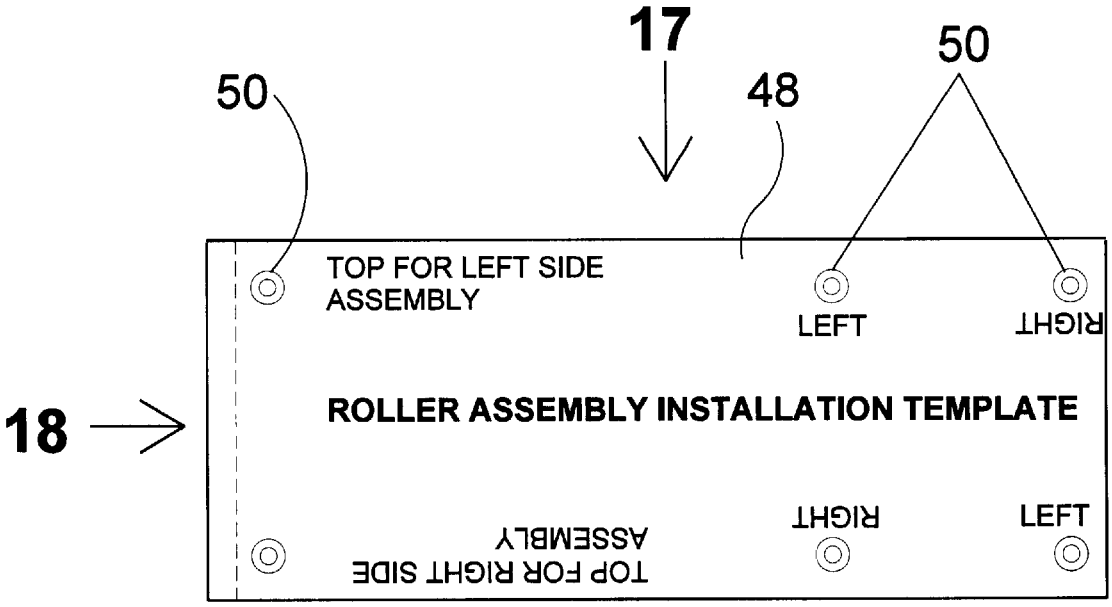
FIG. 16 is a front view of the roller assembly installation template.

Turning to FIG. 16, shown therein is a front view of the roller assembly installation template 48 showing multiple holes 50.

Figure 17:
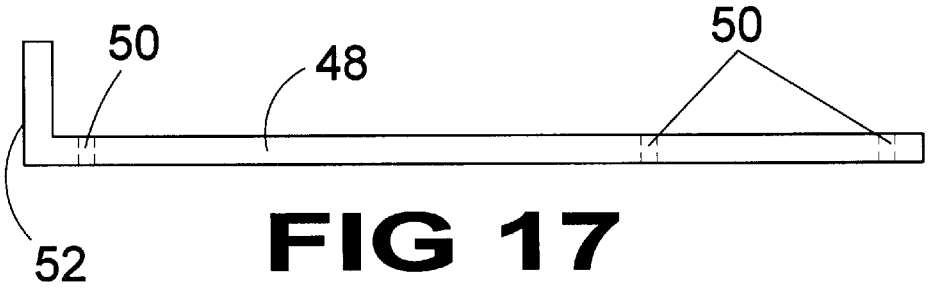
FIG. 17 is a top view of the roller assembly installation template taken from FIG. 16 as indicated.

Turning to FIG. 17, shown therein is a top view of the roller assembly installation template 48 taken from FIG. 16 as indicated showing holes 50 and flange 52.

Figure 18:
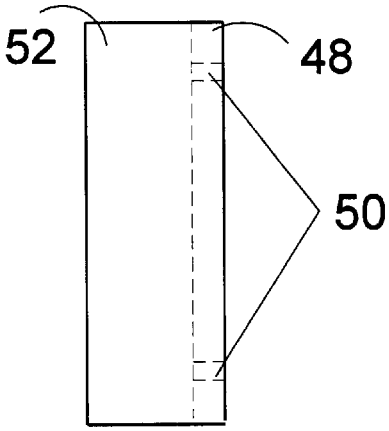
FIG. 18 is a side view of the roller assembly installation template taken from FIG. 16 as indicated.

Turning to FIG. 18, shown therein is a side view of the roller assembly installation template 48 taken from FIG. 16 as indicated showing holes 50 and flange 52.

Figure 19:
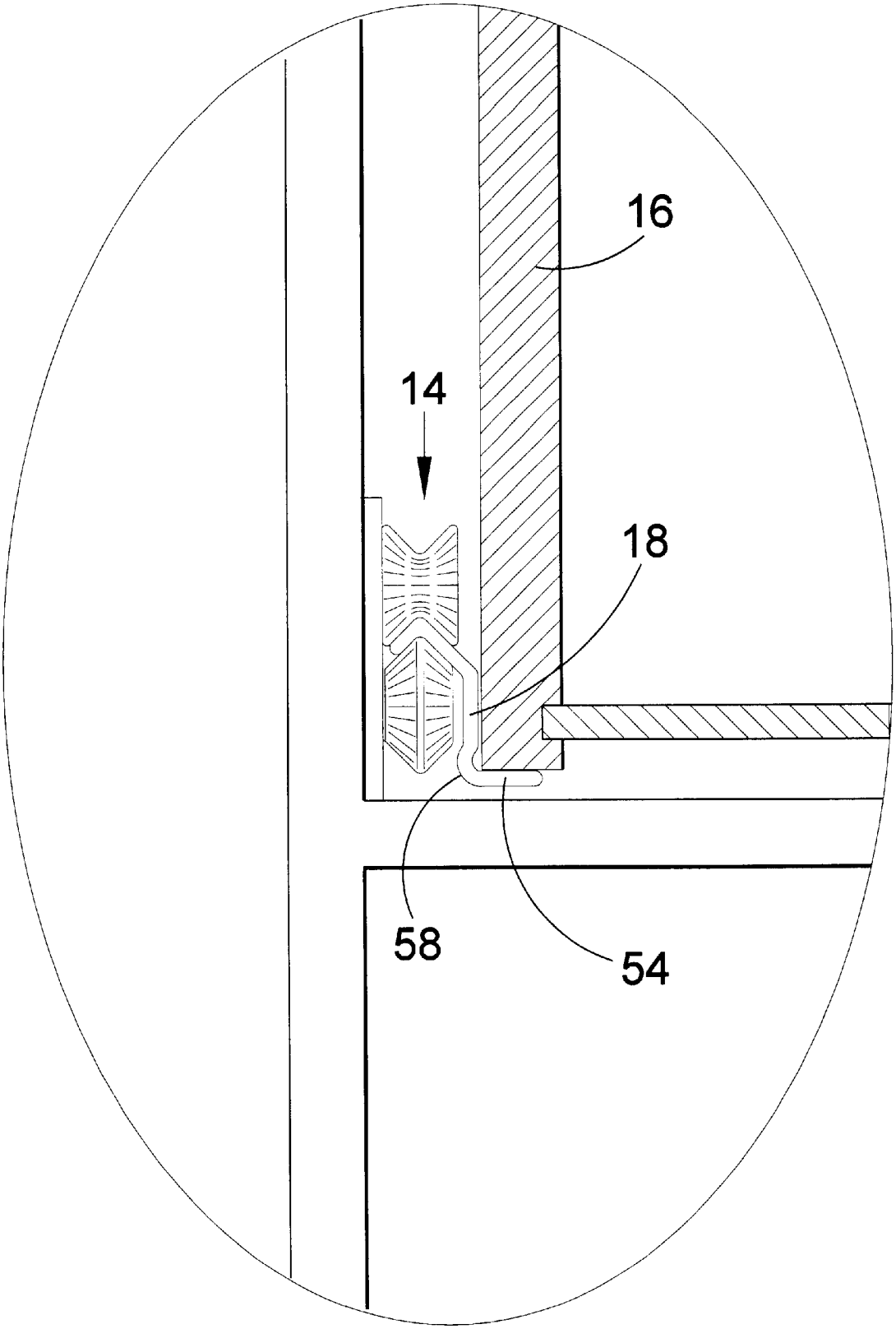
FIG. 19 is a front view of a drawer-like element utilizing assembly mounted rollers with formed rails. Shown is a guide rail having a flange for mounting to the bottom of drawer-like member. Also shown is another variation of the guide roller members having mating like-surfaces compressing a u-like guide roller having a flange mounting member. The formed rails could also be used with screw-mounted rollers. The formed rail has a curved transition between vertical and horizontal sections to accommodate installation of the rail onto a drawer or shelf with a square edge.

Turning to FIG. 19, shown therein is a front view of a drawer-like element 16 utilizing assembly mounted rollers 14 with pre-formed guide rails 18. Shown is a guide rail 18 having a bottom flange 54 for mounting to the bottom of drawer-like member 16. Also shown is another variation of the guide roller members having mating like-surfaces compressing a U-like shaped guide roller 14 having a flange mounting member 54 thereon. The formed rails 18 could also be used with screw-mounted rollers. The formed rail 18 has a curved transition 58 between vertical and horizontal sections to accommodate installation of the rail 18 onto a drawer or shelf with a square edge.

Figure 20:
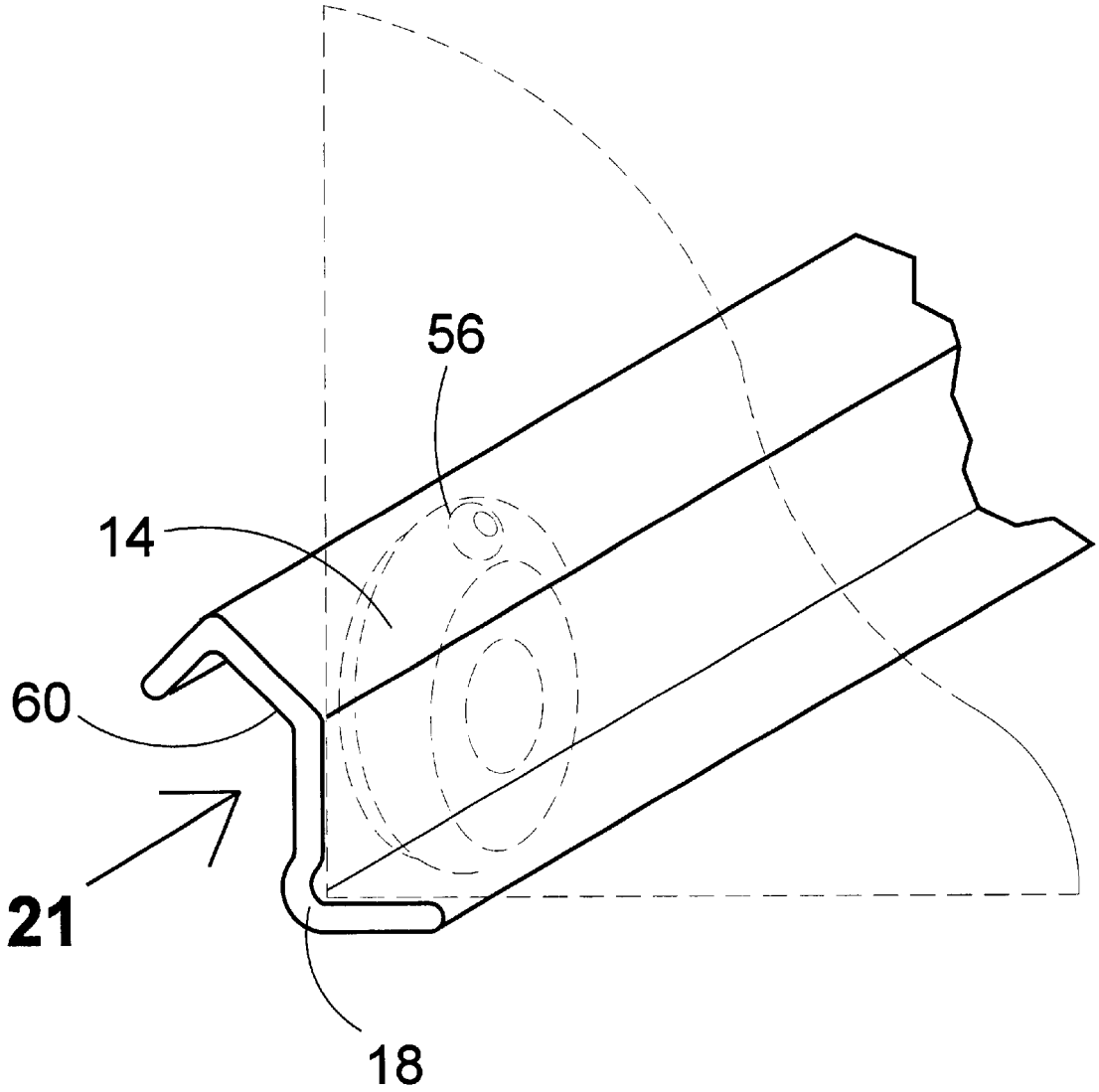
FIG. 20 is a perspective view of a formed rail with a latching system utilizing a compression plug contained within the underside portion which makes contact with rollers. The compression plug is located just forward of where the roller makes contact with the rail when the drawer is in the closed position. The plug compresses when passing over the roller and expands when contact is terminated thereby preventing the drawer from sliding open without the force necessary to compress the plug. The latching force could vary according to the configuration or the density of the plug.

Turning to FIG. 20, shown therein is a perspective view of a formed rail 18 with a drawer latching system utilizing a compression plug 56 contained within the underside portion 60 of rail 18 which makes contact with rollers 14. The compression plug 56 is located just interiorly of where the roller 14 makes contact with the rail 18 when the drawer is in the closed position. The plug 56 compresses when passing over the roller 14 and expands when contact is terminated thereby preventing the drawer from sliding open without the force necessary to compress the plug. The latching force could vary according to the configuration or the density of the plug.

Figure 21:
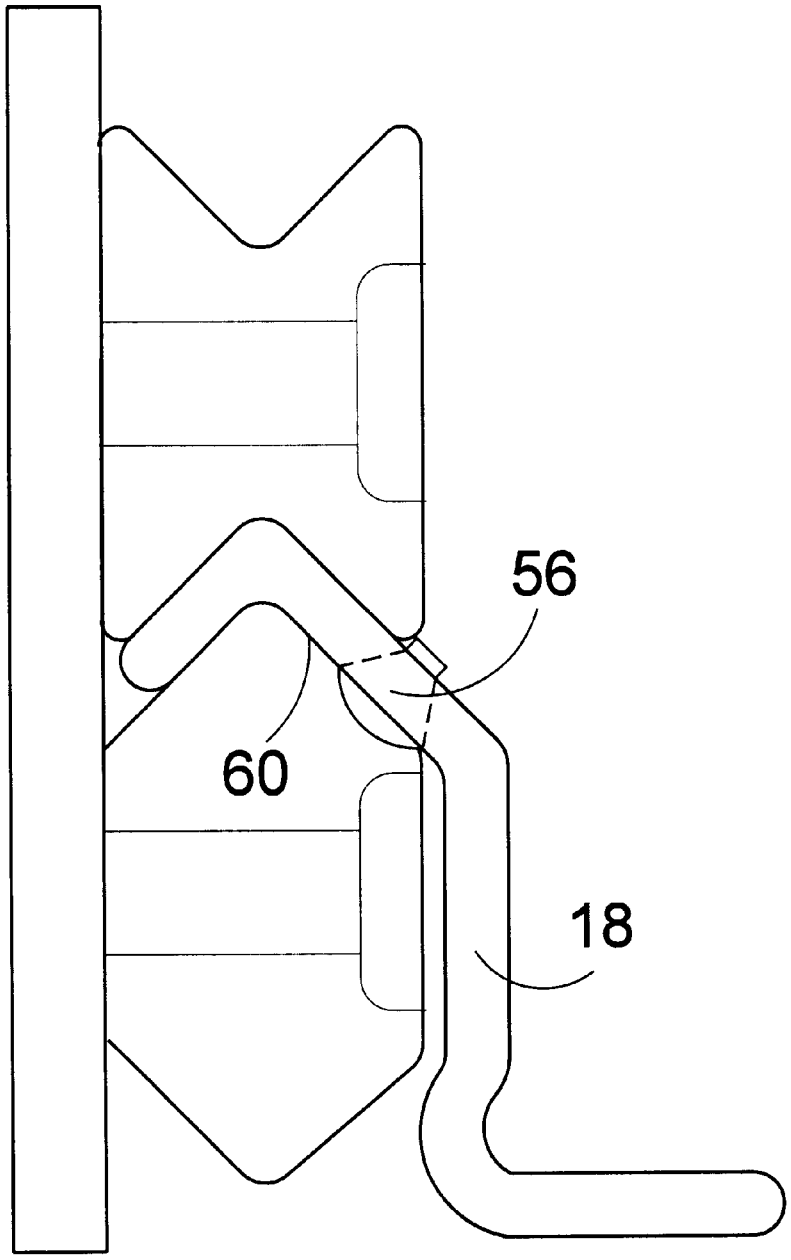
FIG. 21 is a front view taken from FIG. 20 as indicated showing the placement of the compression plug within a formed rail.

Turning to FIG. 21, shown therein is a front view taken from FIG. 20 as indicated showing the placement of the compression plug 56 within a formed rail 18 with underside 60.

Figure 22:
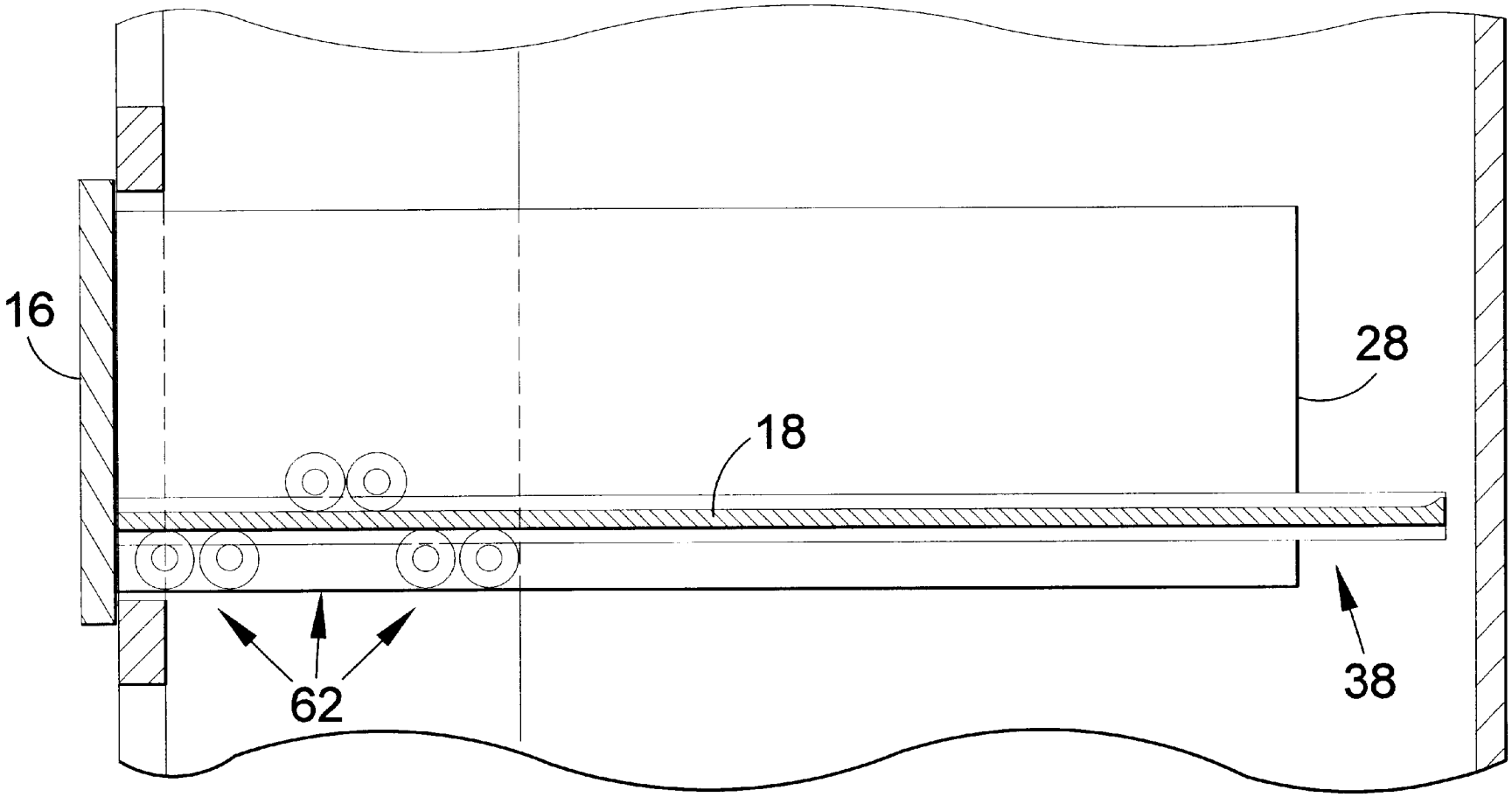
FIG. 22 is a cross sectional view taken from the right side of the furniture sidewall similar to FIG. 2 showing an additional element in the form of dual rollers.

Turning to FIG. 22, shown therein is a cross sectional view similar to FIG. 2. Shown is an alternative mounting of a drawer-like member 16 having a guide rail 18, 38 extending beyond the distal end 28 of the drawer-like member 16 whereby the drawer-like member can be fully extended. Also shown is a partial cutaway view of the guide rail 18. This embodiment shows the present invention having an additional element in the form of dual guide rollers 62.

Figure 23:
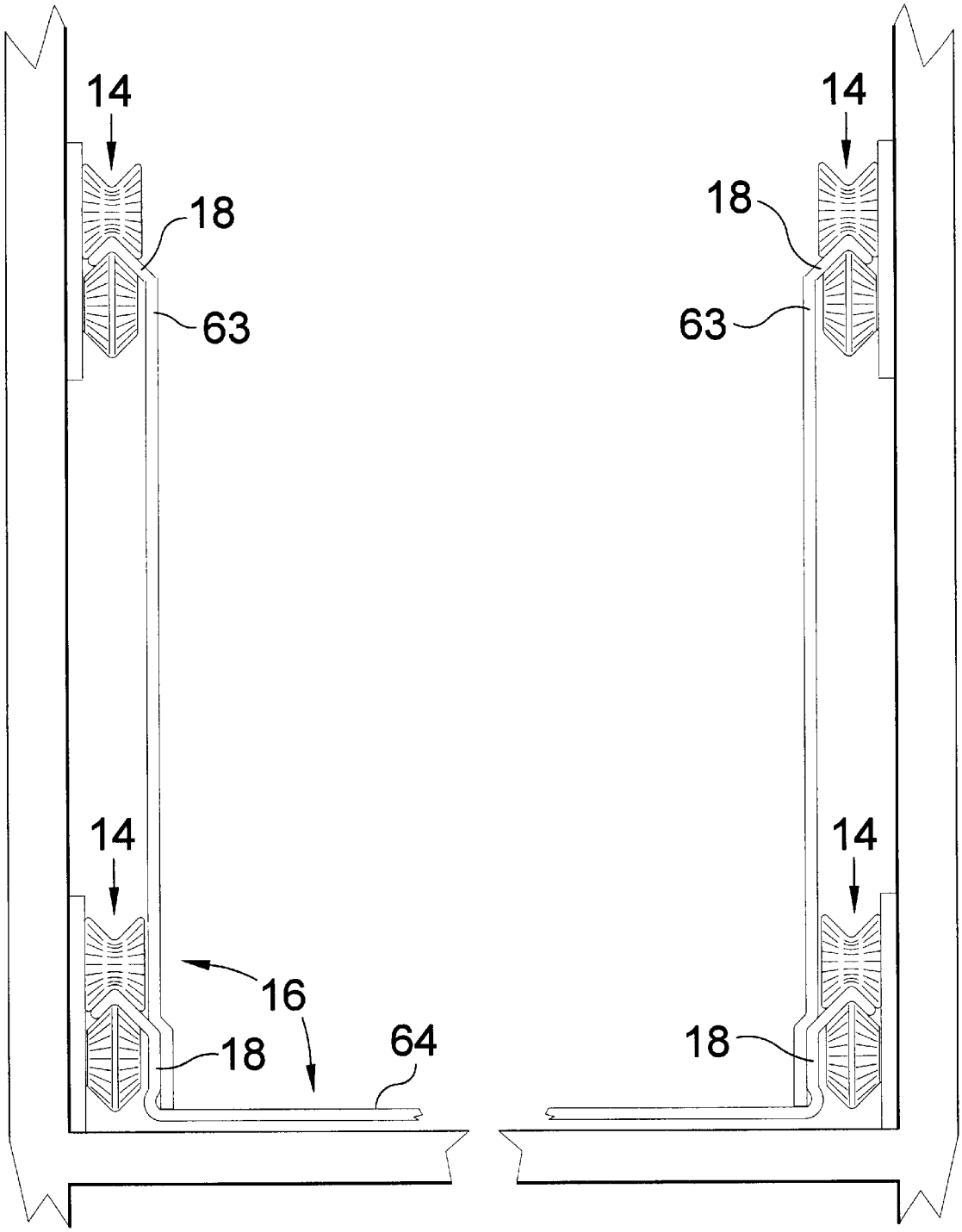
FIG. 23 is a front view of a drawer-like element utilizing assembly mounted rollers with pre-formed guide rails.

Turning to FIG. 23, shown therein is a front view of a drawer-like element 16 utilizing assembly mounted roller 14 with formed guide rails 18 on the top edge 63 and bottom 64 of the drawer 16 thereby forming upper and lower guide rails. Shown is a guide rail 18 having a bottom element 64 which forms the bottom of drawer-like member 16.

Figure 24:
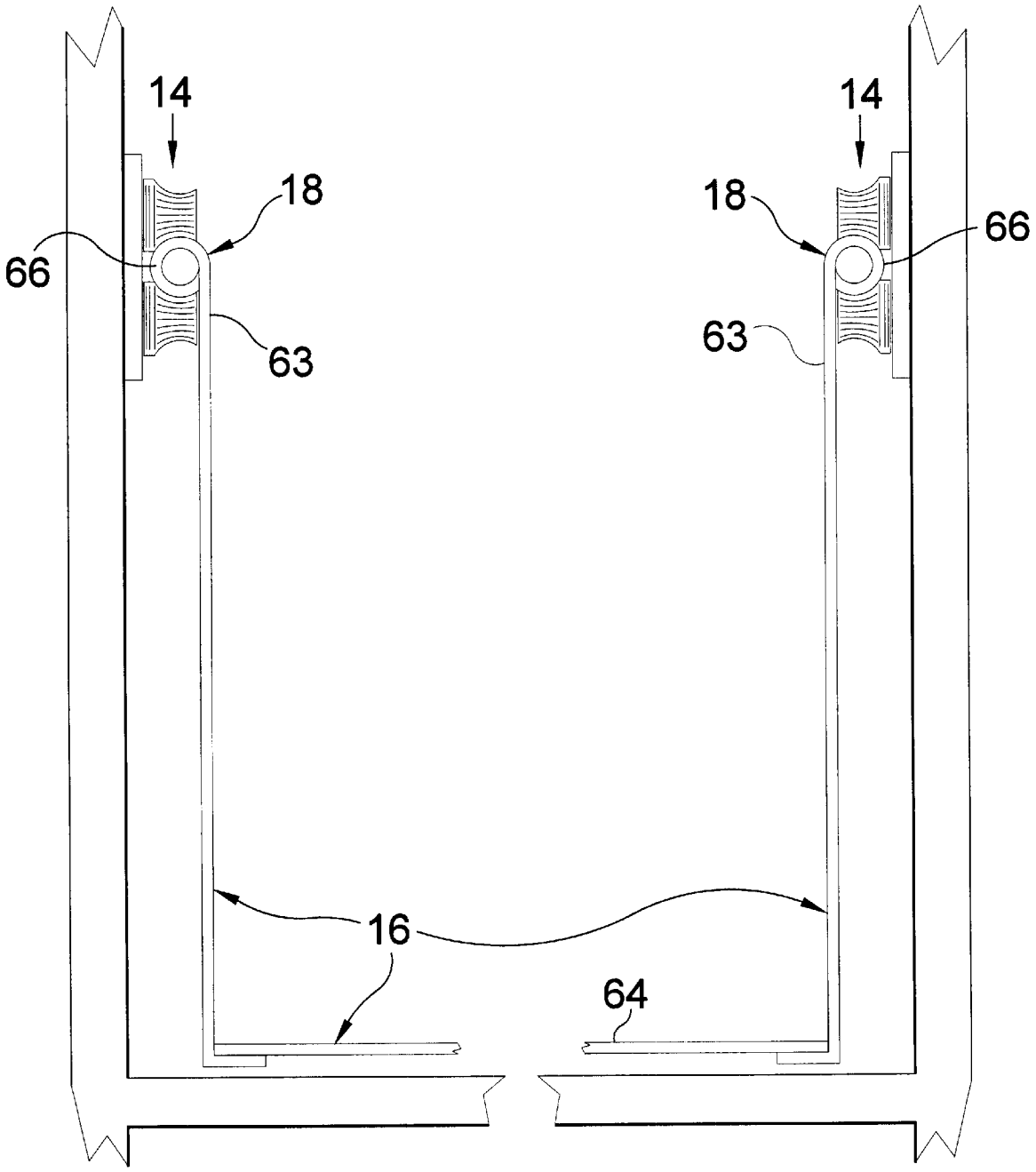
FIG. 24 is a front view of a drawer-like element utilizing assembly mounted rollers with pre-formed guide rails.

Turning to FIG. 24, shown therein is a front view of a drawer-like element 16 utilizing assembly mounted rollers 14 with formed guide rails 18 on the top edge 63 of the drawer 16. Also shown is the bottom 64 of drawer-like member 16. This embodiment shows the top edges 63 being rolled outwardly 66 to form the guide rail 18 for placement between U-shaped upper and lower guide rollers 14.

What is claimed to be new and desired to be protected by Letters Patent is set forth in the appended claims.

I claim:

1. A roller guide system for use on, and in combination with, drawers of furniture, each drawer having a bottom and two sides, comprising:

a) a pair of rails horizontally fixedly mounted onto the perpendicular outer sides of the drawer, said rails having a topside and an underside;

b) a plurality of rollers mounted on opposite interior sidewalls of the furniture for receiving said rails therein;

c) said plurality of rollers including a pair of first and second rollers disposed in a spaced apart relationship for receiving said underside of said rail on each of oppositely facing interior sidewalls;

d) a third roller disposed above and between each said first and second rollers for receiving a topside of said rail, said rollers being disposed in a triangular shaped configuration on oppositely facing sidewalls, said pair of rollers forming the base of said triangular configuration and said third roller forming the apex of said triangular configuration;

e) a drawer stop disposed on the rear of each of said rails, said drawer stop disposed in the topside of each said rail, said drawer stop having a raised portion on the end of said rail;

f) said rollers having apertures therein for receiving fasteners for attaching said rollers to the interior sidewalls of the furniture, the apertures being sized to allow movement of said rollers upon said fasteners, said fasteners being threaded for attaching to the interior sidewalls of the furniture and each fastener having a washer disposed onto the interior sidewall of the furniture whereby said washers structurally reinforce said fasteners;

g) said topside and said underside of said rails being v-shaped for receiving said plurality of rollers;

h) a pair of mounting plates each having mounted thereon a triangular configuration of said rollers, said mounting plates fixedly attached to the interior sidewalls of the furniture;

i) a template having holes therein, said template for use in fixedly mounting each said mounting plate to an interior sidewall of the furniture, said template having said holes arranged such that said template can be used on both opposite sides of said drawer.

2. The apparatus of claim 1, wherein said first pair of rollers and said second roller are disposed in a triangular shaped configuration.

3. The apparatus of claim 2, wherein said first pair of rollers form the base of said triangular configuration and said second roller forms the apex of said triangular configuration.

4. The apparatus of claim 1, wherein said rails are made of wood.

5. The apparatus of claim 4, further comprising said drawer stop disposed in the topside of said rail, said drawer stop having a raised portion on the end of said rail.

6. The apparatus of claim 1, said plurality of rollers having apertures therein.

7. The apparatus of claim 6, said apertures of said rollers for receiving a fastener means for attaching said rollers to the interior sidewall of the furniture.

8. The apparatus of claim 7, wherein said apertures of said rollers are sized to allow movement of said rollers upon said fastener means.

9. The apparatus of claim 7, said fastener means having a threaded means thereon for attaching to the interior sidewall of the furniture.

10. The apparatus of claim 9, said fastener means further comprising washer means disposed onto the interior sidewall of the furniture whereby said washer means structurally reinforces said fastener means.

11. The apparatus of claim 1, said topside and said underside of said rails having grooves therein for receiving said plurality of rollers.

12. The apparatus of claim 1, further comprising a mounting plate having said plurality of rollers disposed thereon, said mounting plates fixedly mounted to the interior sidewall of the furniture.

13. The apparatus of claim 12, further comprising a template having holes therein, said template for use in fixedly mounting said mounting plate to the interior sidewall of the furniture.

14. The roller guide system of claim 1, each said rail having a horizontal bottom flange for mounting to a drawer bottom and a curved transition area from said rail to said flange, each said third roller having a v-shaped groove along the outer perimeter thereof and each of said first and second rollers having a v-shaped perimeter with an apex thereof forming the circumference of said first and second rollers, and the topside and underside of each said rail being v-shaped to accommodate all of said first, second and third rollers.

15. The roller guide system of claim 14, said rail further comprising a compression plug disposed thereon whereby said compression plug acts as a drawer latching system.

16. The apparatus of claim 1, said rails further comprise pre-formed rail means whereby said rail means can be used in conjunction with a U-shaped upper guide roller.

17. The apparatus of claim 16, wherein said pre-formed rail means further comprises upper and lower rail means, said upper pre-formed rail means disposed on the top sides of the drawer, and said lower pre-formed rail means disposed on the bottom of the drawer.

18. The apparatus of claim 17, wherein said lower pre-formed rail means further comprises the bottom of the drawer.

19. The apparatus of claim 16, further comprising a U-shaped lower guide roller, wherein said pre-formed rail means further comprises an upper rail means, said upper rail means disposed on the top sides of the drawer, whereby said upper rail means can be used in conjunction with said U-shaped upper and lower guide roller.

20. The apparatus of claim 19, wherein said pre-formed rail means is formed by the top edges of the sides of the drawer being rolled outwardly.

21. The apparatus of claim 1, wherein said plurality of rollers consists of two rollers.

* * * * *